US005836776A

United States Patent [19]

Koch

[11] Patent Number: 5,836,776

[45] Date of Patent: Nov. 17, 1998

[54] CONNECTOR WITH INTEGRAL INTERNAL SWITCH ACTUATOR AND METHOD OF USING THE SAME

[75] Inventor: Richard M. Koch, Wakefield, Mass.

[73] Assignee: Tru-Connector Corporation

[21] Appl. No.: 920,698

[22] Filed: Aug. 29, 1997

[51] Int. Cl.[6] ..... H01R 29/00

[52] U.S. Cl. ..... 439/188; 200/51.1

[58] Field of Search ..... 439/188; 200/51.1

[56] References Cited

U.S. PATENT DOCUMENTS

| | | | |
|---|---|---|---|
| 3,587,033 | 6/1971 | Brorein et al. | 439/322 |
| 4,861,284 | 8/1989 | Pauza et al. | 439/580 |
| 5,140,659 | 8/1992 | Minds et al. | 439/188 |
| 5,248,259 | 9/1993 | Naito et al. | 439/188 |
| 5,352,127 | 10/1994 | Muller et al. | 439/188 |

OTHER PUBLICATIONS

Facsimile Transmittal letter dated Mar. 6, 1996 from Brad Stimson to Dick Koch with attached drawing.

*Primary Examiner*—Steven L. Stephan
*Assistant Examiner*—T. C. Patel
*Attorney, Agent, or Firm*—Donald J. Perreault

[57] ABSTRACT

An electrical connector including a connector body having a first end and a second end, an axially movable sleeve disposed within the body, and at least one switch actuating pin in contact with the sleeve and axially movable therewith. A first end of the switch body is adapted to removably receive a mating connector for creating an electrical connection between the connector and the mating connector. Upon mating of the first end of the body with the mating connector, a portion of the mating connector contacts the sleeve and moves the sleeve axially within the body in the direction of the second end of the body. Movement of the sleeve causes corresponding movement of the switch actuating pin whereby a first end of the switch actuating pin extends outward from the body. The connector may be positioned adjacent a normally open switch with one terminal of the switch connected to a center conductor the connector and the other terminal of the switch being connected to an electrical signal source. When a mating connector is mated with the connector, a portion of the mating connector contacts the sleeve to cause the pin to extend outward from the body and close the normally open switch. Accordingly, the electrical signal source is connected to the connector of the invention only when a mating connector is mated with the connector.

15 Claims, 5 Drawing Sheets

CONNECTOR WITH INTEGRAL INTERNAL SWITCH ACTUATOR AND METHOD OF USING THE SAME

FIELD OF THE INVENTION

The present invention relates in general to electrical connectors, and in particular to a electrical connector including an integral switch actuator for tripping an external switch upon connection of a mating connector.

BACKGROUND OF THE INVENTION

In high frequency and high power electrical applications, the application of power to associated equipment involves inherent risks which are of a constant concern to both manufacturers and users of such equipment. Power must be applied in a manner which will not damage the equipment, and in a manner which provides a safe environment for users. For example, when high power (i.e. kilowatts) RF signals are transmitted along a cable which is disconnected from a load, i.e. on an open circuit, the energy may be reflected back to the signal source, thereby destroying the same. Also, if a conducting material is in close proximity to the end of the cable through which the high power signal is applied, the signal may arc across an air gap to the conducting material. This could cause serious risks of electrical shock, equipment damage, or fire.

Another concern relates to the risk of electrical shock to the users of the high power equipment. When power is applied along a cable which is disconnected from a load, it is possible that a user may come into physical contact with the "hot" end of the cable. This can occur, for example, through the inadvertent direct contact with the center conductor of the cable, or by inadvertent contact of a hand tool with the center conductor. Regardless of the manner of contact, however, sufficient power to seriously injure or kill a person is frequently applied to the cable. Prevention of contact with the center conductor of the cable is, therefore, of extreme importance.

To date, no simple and efficient mechanical means has been developed for ensuring that power to a load is removed prior to, or simultaneous with, the disconnection of the load to the signal source. Users of high power RF equipment have generally been left to their own resources to limit the risks associated with the application of a high power signal to an open circuit. Most users are highly cognizant of the risks, and are careful to connect a load to a signal source before applying power. Human error and accident, however, frequently result in serious injury to users and damage to equipment.

There is, therefore, a long felt need in the art for an electrical connector, particularly a connector for use in high power RF applications, which is capable of switching the RF signal source off when the connection between the signal source and the load is removed.

OBJECTS OF THE INVENTION

Accordingly, a primary object of the present invention is to provide a connector with an integral internal switch actuating pin which allows electrical current to flow through the connector only when the connector is mated with a mating connector.

Another object of the present invention is to provide a connector with an integral internal switch actuating pin which allows electrical current to flow through the connector only when the connector is mated with a mating connector and which incorporates a mechanism for causing movement of the switch actuating pin that can not easily be overridden by contact of the mechanism with a human finger.

Yet another object of the present invention is to provide a connector with an integral internal switch actuating pin which allows electrical current to flow through the connector only when the connector is mated with a mating connector and which incorporates a mechanism for causing movement of the switch actuating pin that does not cause movement of the center conductor of the connector.

Still another object of the present invention is to reduce the hazard of inadvertent shock associated with high power electrical applications.

A further object of the present invention is to provide a connector with an integral internal switch actuating pin which is of a simple and cost efficient design.

Yet a further object of the present invention is to provide a connector with an integral internal switch actuating pin which is easily assembled.

Still a further object of the present invention is to provide a novel method of preventing connection of an electrical signal source to an open circuit using a connector with an integral internal switch actuator.

These and other objects of the present invention will become apparent from a review of the description provided below.

SUMMARY OF THE INVENTION

The electrical connector of the present invention is organized about the concept of providing a connector having an internal switch actuating pin which extends axially from the switch body upon mating of the switch to a mating connector. The pin trips a normally open external switch for controlling the application of power through the connector. Thus, when the connector of the present invention is connected to a mating connector (i.e. when a load is connected to the signal source), the signal source is switched to the connector by the contact of the pin against the external switch. When the mating connector is removed, the pin withdraws from the switch to return the switch to its normally open state and disconnect the signal source from the connector. A signal can be provided from the signal source to the connector, therefore, only when a mating connector is mated with the connector of the invention. All risks of injury and damage to equipment are eliminated.

Specifically, the connector of the present invention includes a connector body having a first end and a second end, an axially movable sleeve disposed within the body, and at least one switch actuating pin in contact with the sleeve and axially movable therewith. The connector preferably includes a center conductor fixed within the body and disposed within a bore in an insulator. The center conductor extends axially through the sleeve.

A first end of the switch body is adapted to removably receive a mating connector for creating an electrical connection between the connector and the mating connector. Upon mating of the first end of the body with the mating connector, a portion of the mating connector contacts the sleeve and moves the sleeve axially within the body in the direction of the second end of the body. Movement of the sleeve causes corresponding movement of the switch actuating pin whereby a first end of the switch actuating pin extends outward from the body.

In a preferred embodiment, the sleeve is generally cylindrical in shape and includes radial flange at one end thereof.

The radial flange includes portions defining at least one bore therein, and a second end of at least one switch actuating pin is disposed within the bore. The preferred sleeve also includes a radially inward extending portion adapted to contact a portion of the mating connector as the mating connector is mated with the first end of the body. Pressure applied against the radially inward extending portion by the mating connector causes axial motion of the sleeve and the switch actuating pin(s). To bias the switch actuating pin(s) and the sleeve in the direction of the first end, compression springs are provided between the body and the sleeve, and, preferably, around each switch actuating pin.

In one embodiment, the body includes an outer shell having a first end and a mating shell having a first end and a second end. The first end of the mating shell is secured to the first end of the outer shell, and the second end of the mating shell is adapted for removably receiving the mating connector. The mating shell may include a radially extended knurl on an outside surface thereof adjacent the first end thereof. The first end of the outer shell portion is deformed over the knurl to secure the outer shell to the mating shell. The outer shell preferably includes portions defining at least one bore through an end thereof. The switch actuating pin(s) extends through the bore(s) upon mating of the connector with the mating connector.

To facilitate mounting of the connector to an instrument panel, or the like, the connector includes a mounting plate extending from a second end of the outer shell. The mounting plate may be separable from the outer shell, and is adapted to receive at least one fastener therethrough for securing the connector to the instrument panel.

The method of preventing connection of an electrical signal source to an open circuit according to the invention includes the steps of: providing an electrical connector as described above; providing a normally open switch adjacent the first end of at least one switch actuating pin; connecting a first terminal of the normally open switch to the electrical signal source; connecting a second terminal of the normally open switch to a center conductor of the connector; and mating the mating connector with the first end of the body thereby causing the first end of the switch actuating pin to extend outward from the body to close the normally open switch. According to the method of the present invention, therefore, the electrical signal source is connected to the connector of the invention only when a mating connector is mated with the connector. Thus, when the connector is disconnected from a load, no electrical signal is provided to the connector.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

The present invention will now be described in connection with a preferred embodiment which is adapted to mount to an instrument panel, or the like, for making a removable electrical connection between an electrical signal source and an electrical device. Advantageously, the connector includes a switch actuating pin which trips an external switch for controlling the flow of current through the connector in dependence of whether a mating connector is secured to the connector. As will be readily apparent to those skilled in the art, the switch actuating pin of the present invention could easily be incorporated into many connector designs.

Figure 1:
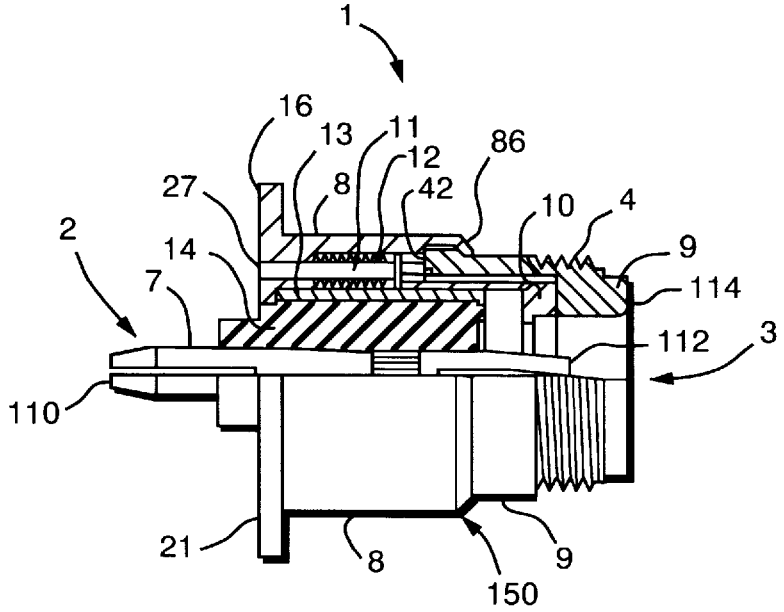
FIG. 1: is a partial sectional view of a preferred connector according to the present invention.
Figure 2:
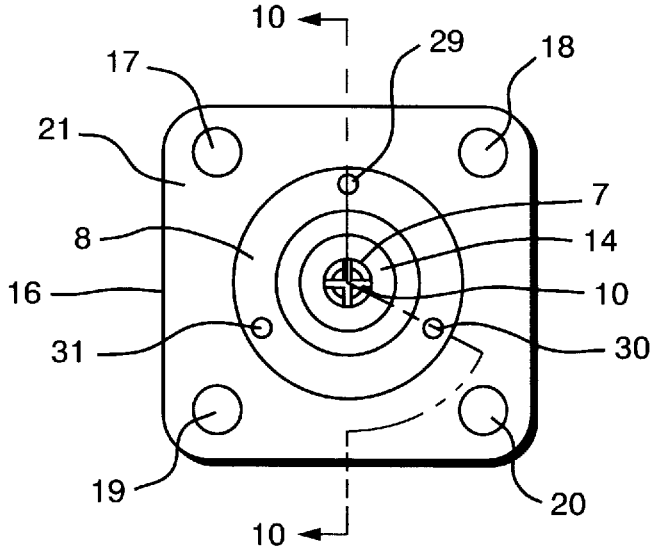
FIG. 2: is an end view of the connector of FIG. 1.

Turning to FIGS. 1–2, a preferred embodiment of the connector 1 generally includes: a switch body 150 including an outer shell 8 and a mating shell 9; an axially movable sleeve 10 disposed within the body 150; one or more switch actuating pins 11 with corresponding compression springs 12; an inner sleeve 13; an insulator 14; a mounting plate 16; and a center conductor 7. At a male end 3 of the connector, the end 110 of the center conductor 7 is positioned axially outward from the bottom surface 21 of the mounting plate 16 to facilitate the formation of an electrical connection between an electrical conductor 118 (FIGS. 10 & 11) and the end 110 of the center conductor, e.g. by soldering. At a female end 3 of the connector, the end 112 of the center conductor is positioned axially inward relative to the top surface 114 of the mating shell 9. The mating shell 9 at the female end 3 is provided with threads 4 for matingly engaging a mating connector 5 (FIG. 11) to create an electrical connection between the center conductor 7 and an electrical device 116 through a center conductor 6 of the mating connector.

Figure 3:
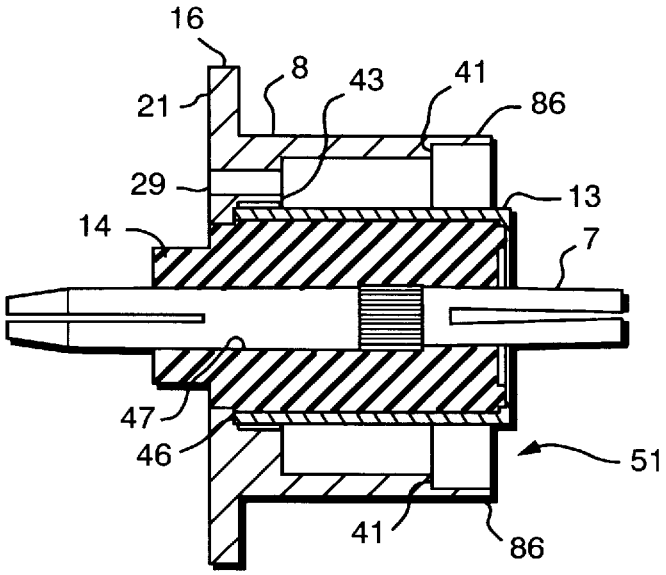
FIG. 3: is a sectional view of a sub-assembly of the connector shown in FIG. 1, showing the interrelationship of the outer shell, the inner sleeve, the insulator, and the center conductor.
Figure 4:
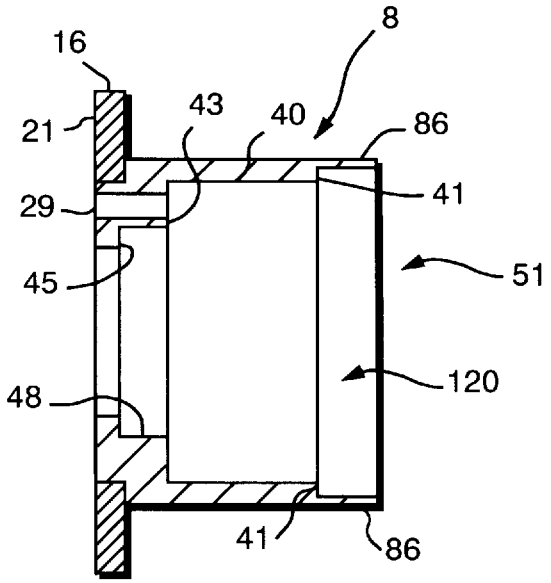
FIG. 4: is a sectional view of the mounting plate and outer shell portion of the connector shown in FIG. 1.

As shown particularly in FIGS. 3 and 4, the outer shell 8 and the mounting plate 16 are preferably formed in two pieces which are secured together, e.g. by brazing. It is also possible, however, to form the outer shell and mounting plate as a single piece. The outer shell 8 is generally cylindrical in shape with a stepped inner surface 40 defining an axial opening 120 therethrough. A first shelf portion 41 of the inner surface 40 provides a stop for a bottom surface 42 of the mating shell 9, as shown in FIG. 1. A second shelf portion 43 provides a contact surface for one end of the compression springs (e.g. 12, 44 in FIGS. 10 & 11) associated with the switch actuating pins 11, 26, etc.. In the areas of the pins, bores, e.g. 29, are formed through the outer shell 8 to intersect the shelf portion 43. The bores are sized to receive the pins so that the pins are axially movable therein under the force applied by the compression springs and under the force applied to the pins through the sleeve 10 by a mating connector.

Figure 5:
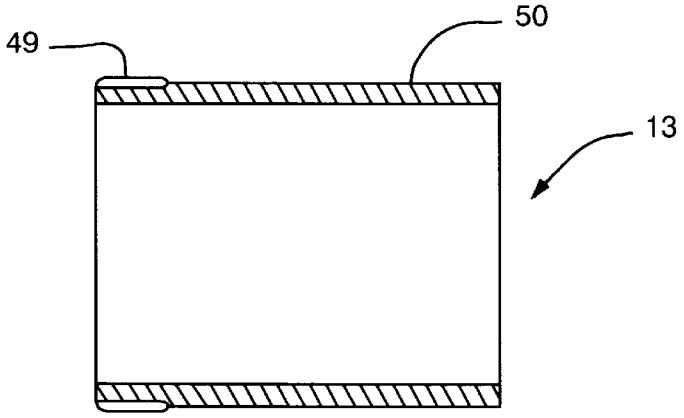
FIG. 5: is a sectional view of the inner sleeve portion of the connector shown in FIG. 1.

A third shelf portion 45 on the inner surface of the outer shell is provided as a contact surface for the end 46 of the tubular inner sleeve 13 which surrounds the insulator 14. As shown particularly in FIG. 5, the bottom outer surface 50 of the inner sleeve includes a knurl 49 which contacts the inner surface 48 above the shelf 45 to secure the sleeve against the outer shell 8. The center conductor 7 extends through and is fixed within a bore 47 in the insulator 14.

Figure 6:
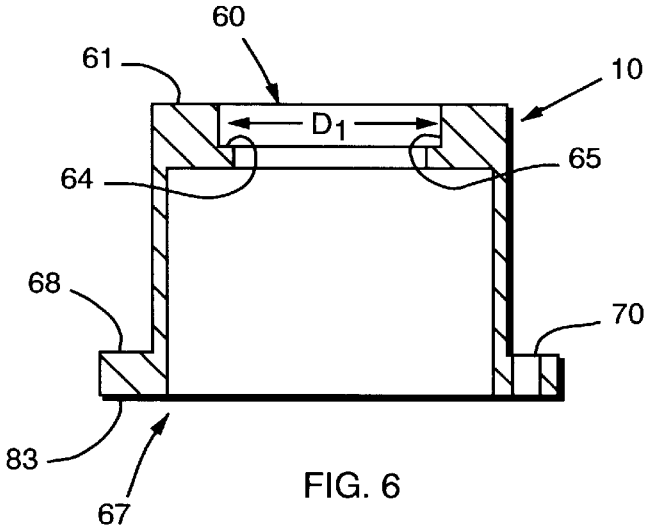
FIG. 6: is a sectional view of the axially movable sleeve portion of the connector shown in FIG. 1.
Figure 7:
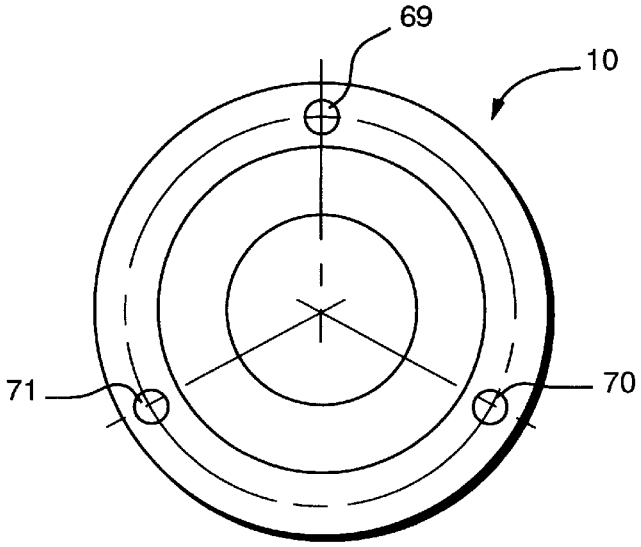
FIG. 7: is an end view of the axially movable sleeve shown in FIG. 6.

Turning now to FIGS. 6 and 7, the axially movable sleeve 10 is generally cylindrical in shape with a stepped inner surface 65. An opening 60 at a first end 61 has a diameter D1 which substantially matches the inside diameter D2 of a bottom portion 62 of an opening 63 in the mating shell 9, shown in FIG. 9. A first shelf portion 64 extends radially inward from the inner surface 65 of the sleeve 10 and provides a contact surface for the outer conductor 66 of the mating connector 5, as shown particularly in FIG. 11.

Figure 8:
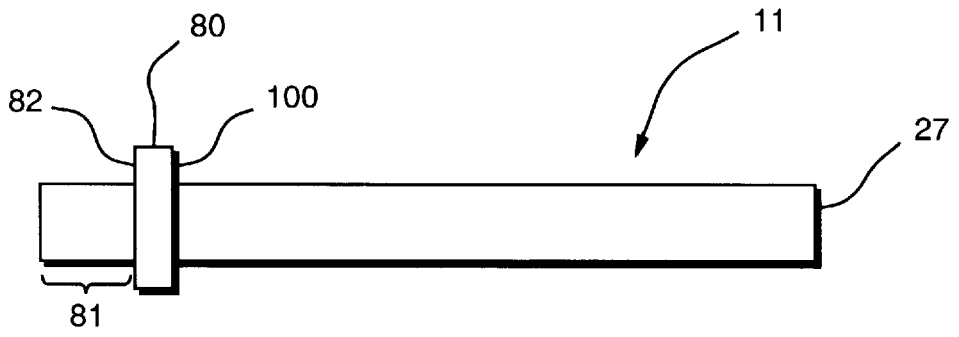
FIG. 8: is a side view of a switch actuating pin according to the invention.

At a second end 67 of the sleeve 10 a radial flange 68 is formed. The flange 68 includes bores 69, 70, 71, as shown in FIG. 7, which receive an end of the pins and which radially correspond with the bores 29, 30, 31 (FIG. 2) in the mounting plate. As shown in FIG. 8, each pin 11 includes a large diameter portion 80, adjacent a first end portion 81. The first end portion 81 of each pin is dimensioned to fit into a bore 69, 70, or 71 with an upper surface 82 of the enlarged diameter portion disposed against the bottom surface 83 of the flange 68. Each pin extends through the center of a compression spring, e.g. 12, so that the compression spring is securely positioned between a bottom surface 100 of the enlarged diameter portion 80 and the first shelf 43 of the outer shell 8.

The compression springs, thus, bias the axially movable sleeve 10 and the pin axially toward end 3 of the connector 1. In this state wherein the connector 1 is disconnected from a mating connector, the end, e.g. 27, of the pin is biased into a position completely beneath the bottom surface 21 of the mounting plate, as shown in FIG. 1. Preferably, the pins and compression springs are positioned at approximately equidistant positions along the perimeter of the flange, as shown in FIGS. 2 and 7, to provide a balanced biasing of the sleeve toward the end 3 of the connector. This allows even axial movement of the sleeve within the switch body and prevents binding of the sleeve which would result from an uneven distribution of forces applied by the compression springs and/or the mating connector.

Figure 9:
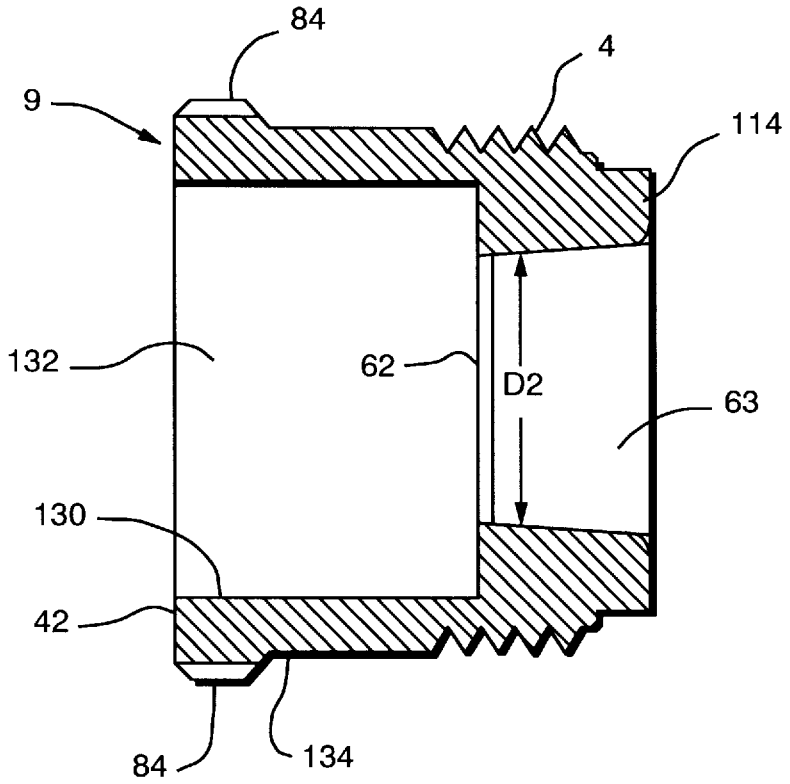
FIG. 9: is a sectional view of the mating shell of the connector shown in FIG. 1.

With reference now to FIG. 9, and also to FIGS. 1 and 3, the mating shell 9 includes stepped inner surface 130 defining an opening therethrough. A large inside diameter portion 132 of the opening at a first end of the mating shell is dimensioned fit over the outside diameter of the sleeve 10 so that the sleeve 10 is slidably movable within the large inside diameter portion 132. The mating shell 9 further includes a radially extended knurl 84 on the outside surface 134 thereof. The mating shell fits into end 51 of the outer shell 8 so that a bottom surface 42 of the mating shell 9 is disposed against the shelf 41 of the outer shell 8. To secure the outer shell 8 to the mating shell, the upper end 86 of the outer shell may be crimped to deform the upper end 86 over the surface of the knurl 84, as shown in FIG. 1.

Advantageously, the connector 1 is designed for easy assembly. The sleeve, pins, compression springs, insulator and center conductor are installed through the end 51 of the outer shell 8. The mating shell 9 is then positioned over the sleeve and forced into the end 51 of the outer shell against the force of the compression springs. Once the bottom surface 42 of the mating shell 9 is in contact with the shelf portion 41 of the outer shell 8, the end 86 is crimped inward over the radially extended knurl 84 to secure the mating shell 9 within the outer shell 8.

Figure 10:
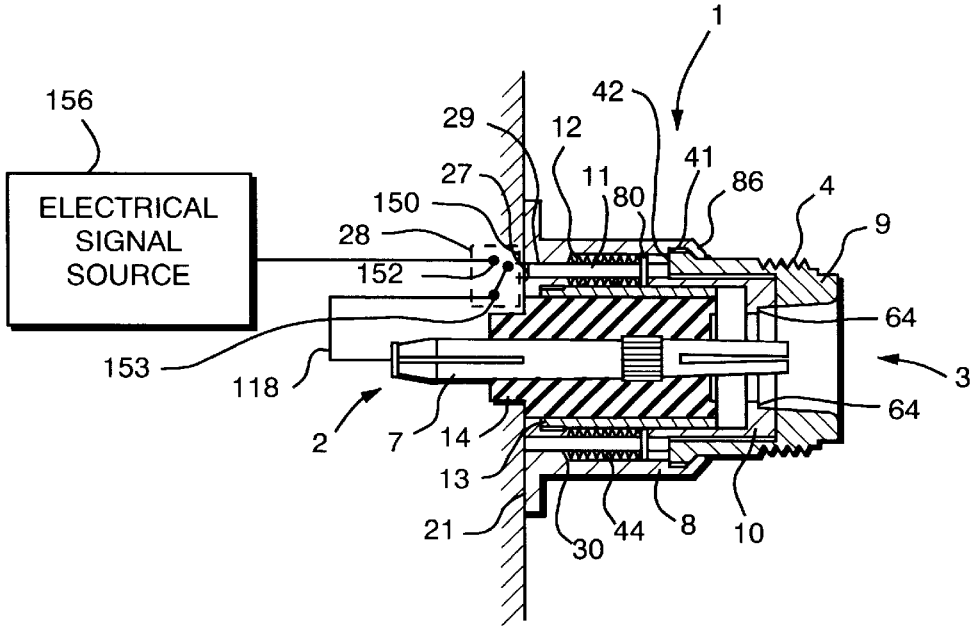
FIG. 10: is sectional view of a connector according to the present invention taken along lines X—X of FIG. 2 showing the connector mounted to an instrument panel and in an unmated state.
Figure 11:
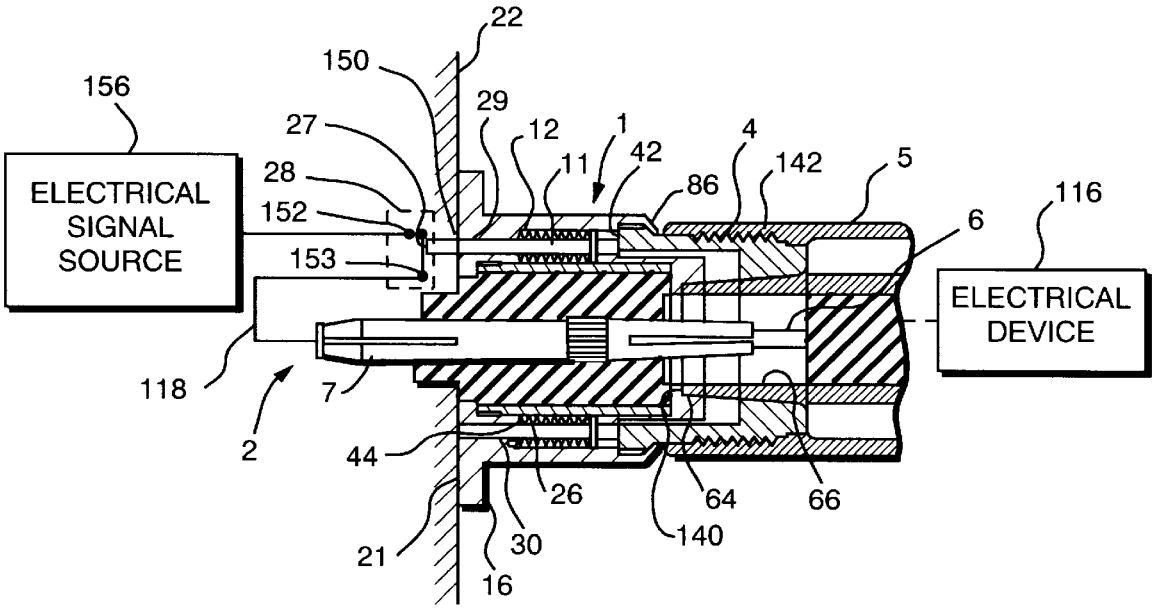
FIG. 11: is sectional view of the connector according to FIG. 10 showing the connector in a mated state with a mating connector.

Turning now to FIGS. 10 and 11, the connector 1 is adapted for mounting to an instrument panel 15 so that at least one of the pin bores 29–31 in the outer shell 8 is in alignment with a corresponding bore 150 in the instrument panel to allow extension of at least one pin outward from a bore 29–31 and through instrument panel bore 150. Once the connector is properly aligned on the instrument panel, it may be secured thereto by installing screws through screw holes 17, 18, 19, 20 (FIG. 2) in the mounting plate 16 and into the instrument panel 15. In operation, therefore, the bottom surface 21 of the mounting plate is disposed against the outer surface 22 of the instrument panel and at least one pin bore 29–31 is in alignment with the corresponding instrument panel bore 150.

To allow for switching of an electrical signal through the center conductor 7, a switch 28 is disposed within the instrument panel adjacent the instrument panel bore 150. In a preferred embodiment, a first switch terminal 152 is electrically connected to an electrical signal source 156 and a second switch terminal 153 is electrically connected to end 110 of the center conductor 7 of the connector 1. The switch 28 is in a normally open state, as shown in FIG. 10, so that no electrical connection is made between the signal source and the center conductor 7.

Advantageously, when the mating connector 5 is mated with the connector 1 by meshing engagement of mating threads 4, 142, as shown in FIG. 11, an end 140 of an outer conductor 66 of the mating connector 5 pressingly engages the shelf 64 of the sleeve 10. When the force applied by the outer conductor 66 against the shelf 64 exceeds the opposing spring force provided by the compression springs, e.g. 12, the sleeve 10 travels axially toward the end 2 of the connector, causing the pins which are positioned within bores 29–30 in the shell 8 to travel axially past the bottom surface 21 of the mounting plate and into the instrument panel bore 150.

The end 27 of a pin then physically trips the switch 28 to close the normally open connection between the two switch terminals 152, 153, thereby establishing an electrical connection between the electrical signal source 156 and an electrical device 116 through the center conductor 7 of the connector 1 and the center conductor 6 of the mating connector 5. When the mating connector is withdrawn from the connector 1, the compression springs force the axially movable sleeve and the pins axially in the direction of the end 3 of the connector to open the switch and return the pins and axially movable sleeve to the unmated position shown in FIG. 10.

With this construction, it is possible to provide an electrical signal through the center conductor 7 of the connector 1 only when the connector 1 is mated with the mating connector 5. Accordingly, the end 112 of the center conductor 7 is never "hot" when it is disconnected from a mating connector. In addition, by positioning the shelf 64 of the sleeve 10 axially inward relative to the top surface 114 of the mating shell, the switching mechanism cannot be overridden by contact with a human finger. The risks of personal injury or damage to equipment resulting from inadvertent contact with the end 112 of the center conductor, or from arcing of an electrical signal from the center conductor, are, therefore, eliminated.

There is thus provided an electrical connector which eliminates the hazards associated with providing a high power electrical signal to an unmated connector. The connector includes an axially movable sleeve for causing axial movement of switch actuating pins. Upon mating of the connector with a mating connector, the sleeve is caused to travel axially within the connector, thereby causing the pins to extend outward from a mounting plate of the connector. An end of at least one pin contacts a normally open switch to close the switch and establish an electrical connection between an electrical signal source and the center conductor of the connector. When the mating connector is removed, the sleeve and the pins withdraw into the connector and the switch is returned to an "open" state.

The embodiments which have been described herein, however, are but some of the several which utilize this invention and are set forth here by way of illustration but not of limitation. For example, the any number of switch actuating pins and corresponding compression springs may be provided, and any pin which is not necessary may be cut so that in the mated state the pin does not extend axially beyond the mounting plate. Also, it would be readily apparent to those skilled in the art that the features of the present invention could be incorporated into a wide variety of connector designs for switching any type of electrical signal. It is obvious that many other embodiments, which will be readily apparent to those skilled in the art, may be made without departing materially from the spirit and scope of this invention.

What is claimed is:

1. An electrical connector comprising:

a connector body having a first end and a second end and a center conductor disposed therein to form an electrical path from said first end to said second end, said first end being adapted to removably receive a mating connector for creating an electrical connection between said center conductor and said mating connector;

an axially movable sleeve disposed within said body; and at least one switch actuating pin in contact with said sleeve, said at least one switch actuating pin being axially movable with said sleeve;

wherein upon mating of said first end of said body with said mating connector, said sleeve moves axially within said body toward said second end of said body thereby causing a first end of said at least one switch actuating pin to extend outward from said body for tripping an external switch.

2. An electrical connector according to claim 1, wherein said sleeve is generally cylindrical in shape.

3. An electrical connector according to claim 1, wherein said sleeve has a radial flange thereon, and wherein said at least one switch actuating pin is in contact with said radial flange.

4. An electrical connector according to claim 3, wherein said radial flange includes portions defining at least one bore therein, and wherein a second end of said at least one switch actuating pin is disposed within said bore.

5. An electrical connector according to claim 1, wherein said sleeve includes a radially inward extending portion, said radially inward extending portion being adapted to contact a portion of said mating connector as said mating connector is mated with said first end of said body to thereby cause axial motion of said sleeve and said at least one switch actuating pin.

6. An electrical connector according to claim 1, wherein a compression spring is disposed within said body between said sleeve and said body.

7. An electrical connector according to claim 6, wherein said at least one switch actuating pin extends axially through said compression spring.

8. An electrical connector according to claim 1, wherein said body comprises:

an outer shell having a first end; and a mating shell having a first end and a second end, wherein said first end of said mating shell is secured to said first end of said outer shell, and wherein said second end of said mating shell is adapted for removably receiving said mating connector.

9. An electrical connector according to claim 8, wherein said mating shell includes a radially extended knurl on an outside surface thereof adjacent said first end thereof, and wherein said first end of said outer shell portion is deformed over said knurl to secure said outer shell to said mating shell.

10. An electrical connector according to claim 8, said connector further comprising a mounting plate extending from a second end of said outer shell, said mounting plate being adapted to receive at least one fastener therethrough for securing said connector to an instrument panel.

11. An electrical connector according to claim 10, wherein said mounting plate is separable from said outer shell.

12. An electrical connector according to claim 8, wherein said outer shell includes portions defining at least one bore through an end thereof, and wherein said switch actuating pin extends through said at least one bore upon mating of said connector with said mating connector.

13. An electrical connector according to claim 1, wherein said connector further comprises a center conductor fixed within said body and extending axially through said sleeve.

14. An electrical connector according to claim 13, said connector further comprising an insulator having a bore therein, wherein said center conductor is disposed within said bore.

15. An electrical connector comprising:

a connector body having a first end and a second end and a center conductor disposed therein to form an electrical path from said first end to said second end, said first end being adapted to removably receive a mating connector for creating an electrical connection between said center conductor and said mating connector;

an axially movable sleeve disposed within said body, said sleeve being generally cylindrical in shape and having a radial flange at a first end thereof and a radially inward extending portion, said radially inward extending portion being adapted to contact a portion of said mating connector as said mating connector is mated with said first end of said body; and at least one switch actuating pin in contact with said radial flange, said at least one switch actuating pin being axially movable with said sleeve, wherein upon mating of said first end of said body with said mating connector, said portion of said mating connector contacts said radially inward extending portion of said sleeve to cause said sleeve to move axially within said body toward said second end of said body, thereby causing a first end of said at least one switch actuating pin to extend outward from said body for tripping an external switch.

* * * * *